United States Patent [19]

Carino

[11] Patent Number: 5,036,924

[45] Date of Patent: Aug. 6, 1991

[54] CONTAINER FIRE NOZZLE HOLE ADAPTER

[76] Inventor: Ralph Carino, 216 Hampton Ct., Santa Rosa, Calif. 95409

[21] Appl. No.: 557,466

[22] Filed: Jul. 25, 1990

[51] Int. Cl.[5] ..... A62C 31/02

[52] U.S. Cl. ..... 169/70; 169/62; 239/208

[58] Field of Search ..... 169/51, 53, 62, 70; 239/208, 396

[56] References Cited

U.S. PATENT DOCUMENTS

| | | | |
|---|---|---|---|
| 1,898,117 | 2/1933 | Boosey | 169/70 |
| 4,047,572 | 9/1977 | Stary et al. | 169/70 X |
| 4,223,740 | 9/1980 | Clayton | 169/70 |
| 4,872,513 | 10/1989 | Gardner et al. | 169/70 X |

*Primary Examiner*—Joseph F. Peters, Jr.
*Assistant Examiner*—Carla Mattix
*Attorney, Agent, or Firm*—Richard L. Miller

[57] ABSTRACT

A container fire nozzle hole adapter is provided for a wall structure having an opening. The adapter consists of a male component having a central aperture and a female component having a central hole therethrough sized to slip over the male component when the male component extends into the opening in the wall structure. The female component is mounted onto the male component within the container against the wall structure so that the adapter will be secured to the wall structure. A fire nozzle can be inserted into the central aperture of the male component for extinguishing a fire within the container.

4 Claims, 2 Drawing Sheets

CONTAINER FIRE NOZZLE HOLE ADAPTER

BACKGROUND OF THE INVENTION

The instant invention relates generally to a container fire nozzle hole adapter.

Numerous fire-fighting equipment have been provided in the prior art that are adapted to penetrate a partition structure so that a fire therein can be extinguished from the other side of the partition structure. For example, U.S. Pat. Nos. 389,025 to Stevens; 2,052,384 to Conran and 4,625,808 to Halfpenny all are illustrative of such prior art. While these units may be suitable for the particular purpose to which they address, they would not be as suitable for the purpose of the present invention as hereafter described.

SUMMARY OF THE INVENTION

A primary object of the present invention is to provide a container fire nozzle hole adapter that will overcome the shortcomings of the prior art devices.

Another object is to provide a container fire nozzle hole adapter built into a wall structure of the container, through which the fire nozzle is inserted for extinguishing a fire.

An additional object is to provide a container fire nozzle hole adapter that includes a removable seal member to indicate the location of the adapter as well as to protect the contents of the container from moisture, dust, etc. from an outside environment.

A further object is to provide a container fire nozzle hole adapter that is simple and easy to use.

A still further object is to provide a container fire nozzle hole adapter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
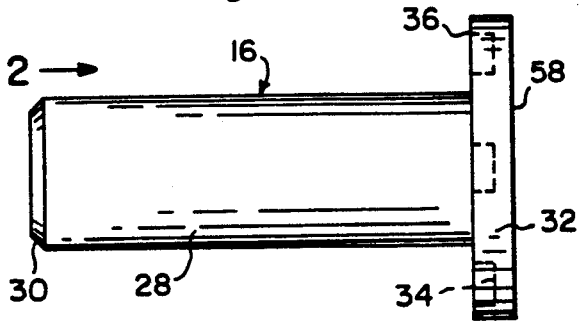
FIG. 1 is a diagrammatic side view of the male component of the instant invention.
Figure 2:
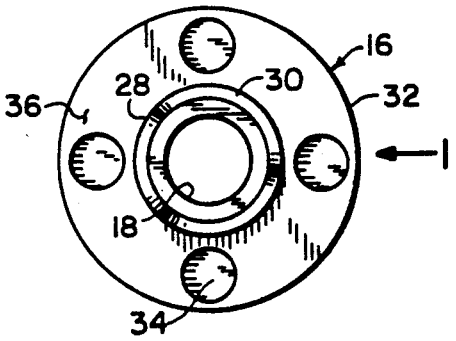
FIG. 2 is an end view taken in the direction of arrow 2 in FIG. 1.
Figure 6:
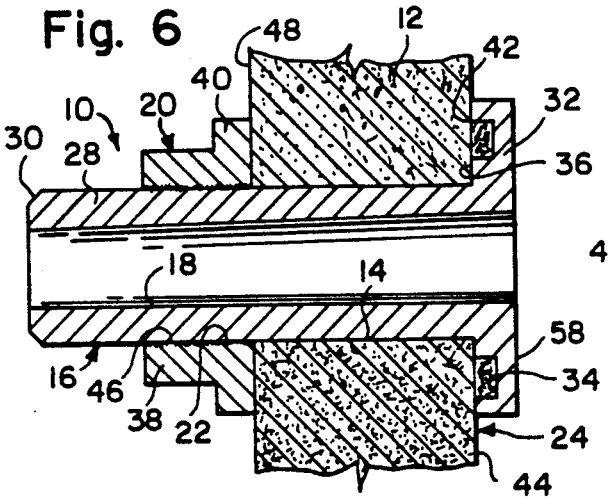
FIG. 6 is a diagrammatic cross sectional view taken on line 6—6 of FIG. 3.
Figure 4:
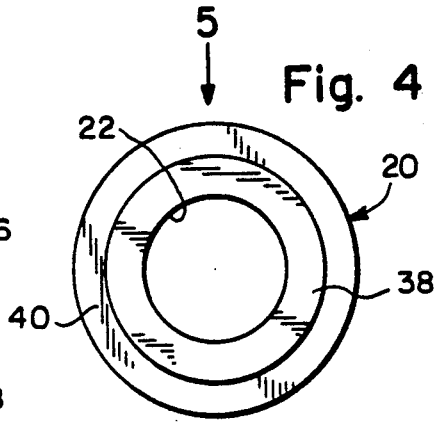
FIG. 4 is an end view of the female component of the instant invention.
Figure 5:
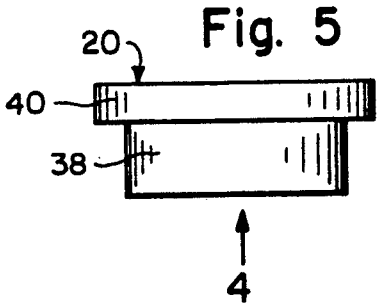
FIG. 5 is a side view taken in the direction of arrow 5 in FIG. 4.
Figure 3:
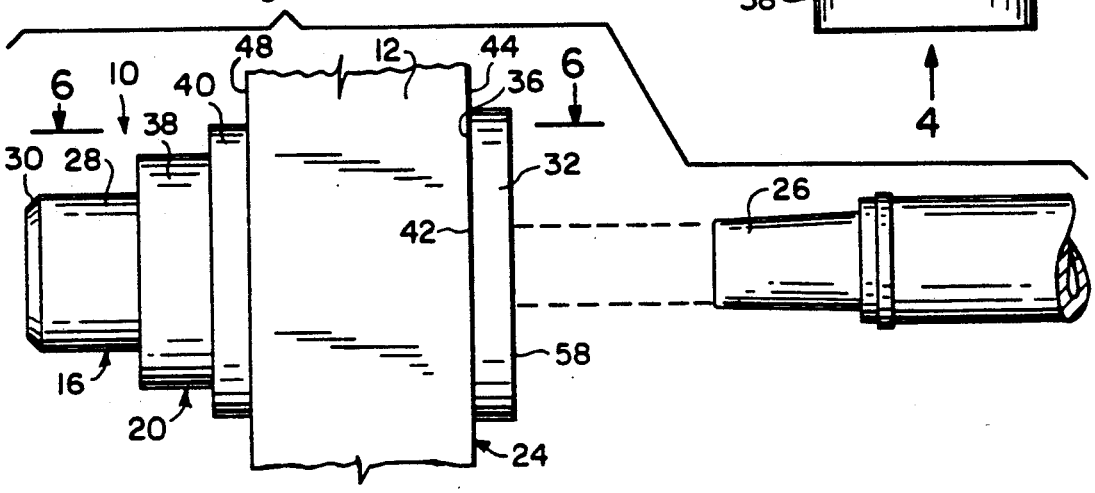
FIG. 3 is an assembled view of the instant invention shown mounted through a typical wall structure.

Turning now descriptively to the drawings, in which like reference characters denote like elements throughout the several views, FIGS. 3 and 6 illustrate a container fire nozzle hole adapter 10 for a wall structure 12 having an opening 14. The adapter 10 consists of a male component 16 (see FIGS. 1 and 2) having a central aperture 18 therethrough, and a female component 20 (see FIGS. 4 and 5) having a central hole 22 therethrough sized to slip over the male component 16. The male component 16 is mounted to the wall structure 12 of the container 24 when the male component 16 extends into the opening 14 in the wall structure 12. The female component 20 is mounted onto the male component 16 within the container 24 against the wall structure 12 so that the adapter 10 will be secured to the wall structure 12. A typical fire nozzle 26 (shown in FIG. 3) can be inserted into the central aperture 18 of the male component 16 for extinguishing a fire within the container 24.

The male component 16 includes an elongated sleeve 28 having the central aperture 18 therethrough with a bevel 30 at one end and a flange 32 at the other end. The flange 32 has a plurality of indentations 34 in the inner surface 36 thereof. The female component 20 includes a hub 38 having the central hole 22 therethrough with a collar 40 at one end. The central hole 18 is sized to slip over the elongated sleeve 28 of the male component 16.

Mastic cement 42 is applied to the inner surface 36 and indentations 34 of the flange 32, so that when the elongated sleeve 28 is inserted through the opening 14 in the wall structure 12, the mastic cement 42 will secure the flange 32 to the outer surface 44 of the wall structure 12. Polyvinyl chloride (P.V.C.) glue 46 is applied to the outer surface of the elongated sleeve 28 of the male component 16 extending through the wall structure 12, so that when the hub 38 of the female component is slipped over the elongated sleeve 28 with the collar 40 against the inner surface 48 of the wall structure 12 the P.V.C. glue will secure the hub 32 to the elongated sleeve 28.

Figure 7:
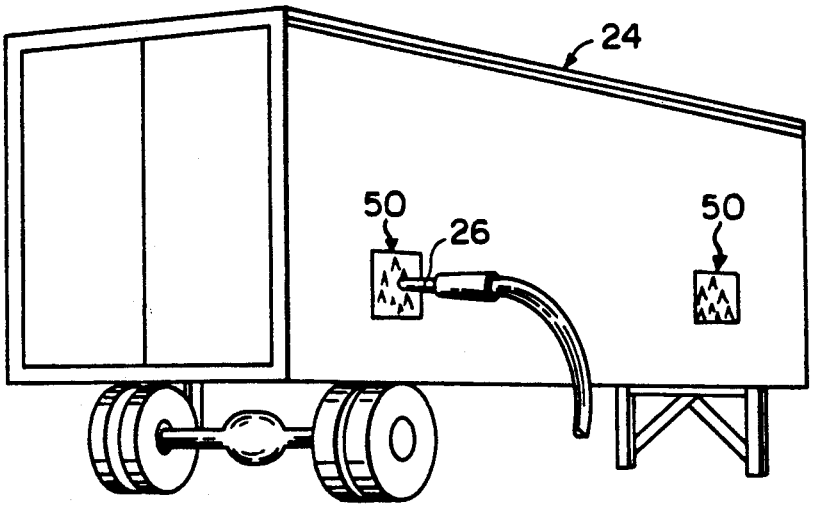
FIG. 7 illustrates the invention installed in a typical trailer truck body.
Figure 8:
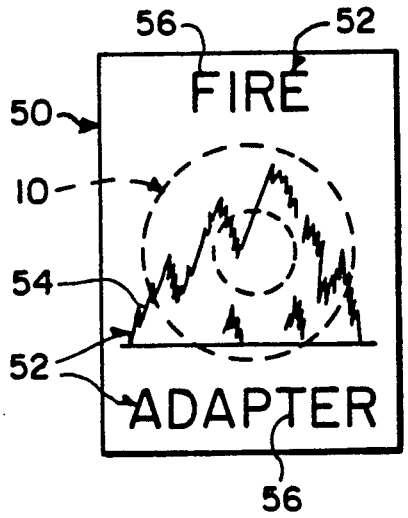
FIG. 8 illustrates the seal member per se.

As shown in FIG. 7 and 8, a pierceable seal member 50 is also provided having indicia 52 thereon, which can be a fire symbol 54 and words 56, such as "FIRE ADAPTER". The seal member 50 is affixed over the outer surface 58 of the flange 32 on the male component 16 and the outer surface 44 of the wall structure 12 to indicate the location of the adapter 10 as well as to protect the contents of the container 24 from moisture, dust, etc. from the outside environment.

Operationally, in the event of a fire within the container 24, the pierceable seal member 50 is penetrated. The fire nozzle 26 which is connected to a carbondioxide or halon portable fire extinguisher can be inserted into the adapter 10 so that the contents of the fire extinguisher can be discharged into the container 24 for suppressing the fire without the need for entering the container 24.

The container 24 can be a typical trailer truck body as shown in FIG. 7 used in the transportation industry. The container 24 can be a compartment found in educational, industrial and commercial buildings, as well as aboard aircraft, ships, boats and land vehicles.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A container fire nozzle hole adapter for a wall structure having an opening, said adapter comprising:

(a) a male component including an elongate sleeve of constant external cross-sectional size having a bevel at one end and a flange at the other end, the flange having an inner surface for engaging an outer surface of the wall structure and formed with a plurality of recesses, and a central aperture extending from the one to the other end;

(b) a female component including a hub formed with a central hole therethrough and a collar portion at one end for engagement with an inner surface of the wall structure, the central hole being sized to slip over the elongate sleeve of said male component;

(c) male component mounting means including mastic cement applied to the inner surface and recesses of the flange so that when the elongate sleeve is inserted through the opening in the wall structure said mastic cement will secure the flange to the outer surface of the wall structure; and (d) female component mounting means including adhesive applied to the outer surface of the elongate sleeve of said male component extending through the wall structure so that when the hub of said female component is slipped over the elongate sleeve with the collar against the inner surface of the wall structure, said adhesive will secure the hub to the elongate sleeve thereby to assemble said adapter on the wall structure so that a fire nozzle can be inserted into the central aperture of said male component for extinguishing a fire within the container.

2. An adapter as recited in claim 1, further including a pierceable seal member having indicia thereon affixed over the outer surface of the flange on said male component and the outer surface of the wall structure to indicate the location of said adapter as well as to protect the contents of the container from moisture, dust, etc. from an outside environment.

3. An adapter as recited in claim 1, wherein said adhesive is PVC glue.

4. An adapter as recited in claim 1, wherein said central aperture tapers as it extends through the male component from the other end to the one end.

* * * * *